United States Patent [19]

Shaver et al.

[11] Patent Number: 4,468,004

[45] Date of Patent: Aug. 28, 1984

[54] PORTABLE LIFTING DEVICE

[76] Inventors: Brian W. Shaver, 6 Lyndfield Crescent, Brampton, Ontario, Canada, L6W 2P5; Patrick J. Palangio, 41 Forest Park Rd., Orangeville, Ontario, Canada, L9W 1A1

[21] Appl. No.: 453,272

[22] Filed: Dec. 27, 1982

[30] Foreign Application Priority Data

Nov. 1, 1982 [CA] Canada ..... 414591

[51] Int. Cl.[3] ..... B66D 3/02

[52] U.S. Cl. ..... 254/325; 254/334

[58] Field of Search ..... 254/325, 326, 327, 334, 254/338

[56] References Cited

U.S. PATENT DOCUMENTS

| | | | |
|---|---|---|---|
| 1,026,901 | 5/1912 | Brown | 254/326 X |
| 2,588,749 | 3/1952 | Nilsson | 254/139 |
| 2,821,726 | 2/1958 | Correll | 254/327 X |
| 2,918,718 | 12/1959 | Oberwegner | 27/28 |
| 3,123,229 | 3/1964 | Kleiman | 214/1 |
| 3,363,269 | 1/1968 | Kossuth | 5/81 |
| 4,191,416 | 3/1980 | Nist | 294/74 |

*Primary Examiner*—Stuart S. Levy
*Assistant Examiner*—Joseph J. Hail, III

[57] ABSTRACT

A portable lifting device designed for the removal of an injured person from a boom supported aerial bucket having a peripheral flange, the device comprising a davit having a footing adjacent one end thereof, the footing being engageable with the bucket flange for supporting the davit in an operative position, a pulley mounted at the other end of the davit, and a winch unit mounted on the davit, the winch unit having a cable extending over the pulley, the cable providing at its free end means for securing engagement with an injured person to be removed from the bucket.

5 Claims, 4 Drawing Figures

PORTABLE LIFTING DEVICE

FIELD OF THE INVENTION

This invention relates generally to emergency rescue equipment and is concerned particularly with lifting devices designed for the removal of injured persons from boom supported aerial buckets.

BACKGROUND OF THE INVENTION

Boom supported aerial buckets, of the type having a peripheral flange, are widely used in many industries and are most extensively used in the power and utility industries where it is frequently necessary to provide mobile access to power lines and other electrical facilities. In using such aerial buckets repairmen are exposed to risk of serious injury, and it is generally recognized that facilities must be provided for the immediate emergency treatment of an injured repairman. Whereas the boom can usually be lowered to bring the bucket to ground level, it may be extremely difficult to lift the person from the bucket, particularly if the person is unconscious or otherwise incapacitated.

Numerous attempts have been made to deal with this problem, the commonest being based on the use of a block and tackle mounted on the boom itself whereby the injured repairman may be simply lifted from the bucket. This has a number of drawbacks, one being that the lifting system must first be moved into the operative position, which means that the hydraulic system of the aerial device must remain fully operative after the accident has occurred. Another drawback is that a lift assembly permanently mounted on the device adds to its weight, while also making it difficult or impossible to keep the boom clear as it must for high voltage work. Then again, a permanently mounted lift assembly is subject to deterioration through continual exposure, making it unreliable when needed.

On the other hand, in the case of a separate lift assembly to be mounted on the ground, ground features such as ditches, rocks, etc. may limit access to the bucket on one or more sides.

SUMMARY OF THE INVENTION

The present invention provides an improved lifting device which is free from the above-mentioned drawbacks. The device is portable, can easily be stored when not in use, and is adaptable in that it can easily be installed in a self-supporting position on any of three sides of the aerial bucket.

Thus, according to the invention, a portable lifting device designed for the removal of an injured person from a boom mounted aerial bucket having a peripheral flange comprises a davit having a footing adjacent one end thereof, the footing being engageable with the bucket flange for supporting the davit in an operative position, a pulley mounted at the other end of the davit, and a winch unit mounted on the davit, the winch unit having a cable extending over the pulley, the cable providing at its free end means for securing engagement with an injured person to be removed from the bucket.

BRIEF DESCRIPTION OF THE DRAWINGS

In order that the invention may be readily understood, one embodiment thereof will now be described, by way of example, with reference to the accompanying drawings, in which.

DESCRIPTION OF THE PREFERRED EMBODIMENTS

Figures 1, 2:
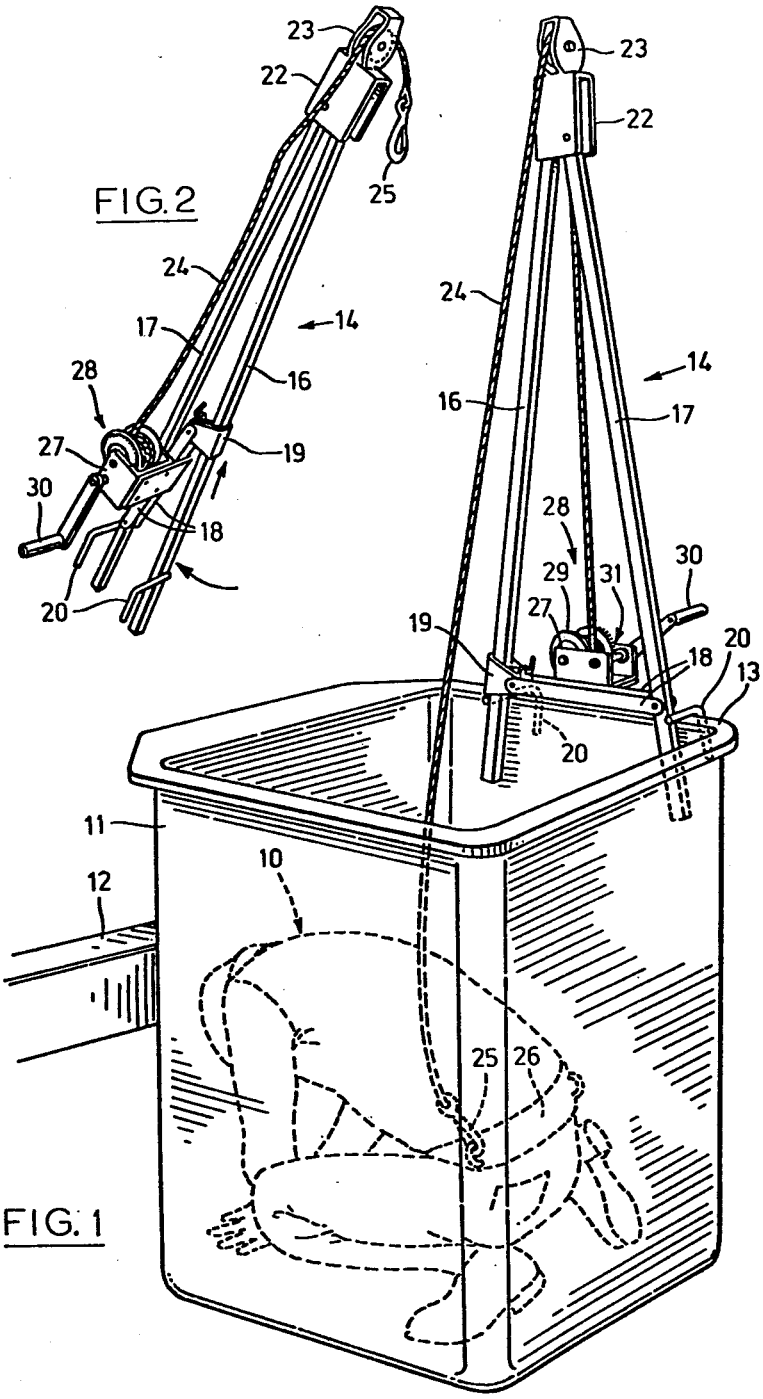
FIG. 1 illustrates one lifting device according to the invention, operatively mounted on an aerial bucket in which the injured subject has fallen.
FIG. 2 illustrates the device when collapsed for stowage.

FIG. 1 shows the injured subject 10, who has fallen awkwardly inside the aerial bucket 11 and who is in need of immediate emergency treatment. The bucket 11, which is mounted on a boom 12 in the conventional way, has been lowered to the ground, but the problem is to remove the subject so that he can be treated.

The aerial bucket 11 is of the conventional box type having a top opening with a peripheral flange or lip 13. The rescue device, or lifting device 14 comprises a davit having a footing by which it can readily be mounted in a self-supporting operative position on the flange 13. As can be seen in FIG. 1, the davit can be located at any of the three sides of the bucket, other than the boom side.

The davit 14 is in the form of a collapsible A-frame which can be collapsed for stowage, as shown in FIG. 2. The A-frame comprises two legs 16, 17 hinged together at their upper ends, and a transverse bar 18 extending between the legs 16, 17 to maintain the frame rigid when operative. The transverse bar 18 is pivotally connected at one end to the leg member 17, and is connected at its other end to a sliding plate member 19 slidably arranged on the leg member 16, as shown in FIG. 2, to permit the legs 16, 17 to be folded together. In the operative position of the davit, the sliding plate member 19 is at its lower limit position defined by a foot 20.

The footing of the davit comprises a pair of flange engaging feet 20, one on each of the leg members 16 and 17. The feet 20 are constituted by a pair of transverse aligned angle members rigidly attached to the leg members and positioned to extend outwardly therefrom with respect to the bucket 11. Each of these angle members has an outwardly extending bearing portion adapted to bear on the flange 13, with a downturned end portion adapted to engage the outer edge of the flange. The lower ends of the leg members 16, 17 extend beyond the feet 20 so as to bear against the inside of the bucket wall when the davit is in use, thereby supporting the davit in the operative position.

At the upper end of the davit is a mounting plate 22, on which a pulley 23 is mounted. The pulley 23 serves as a return pulley for a winch cable 24, at the free end of which is a clip 25 or other attachment means for attachment to the subject's safety belt or harness 26. The transverse bar carries a mounting plate 27, on which is mounted a winch unit 28 for the cable 24. The winch unit comprises a cable drum 29 having a crank handle 30 for operating the winch unit manually through reduction gearing 31.

Figure 4:
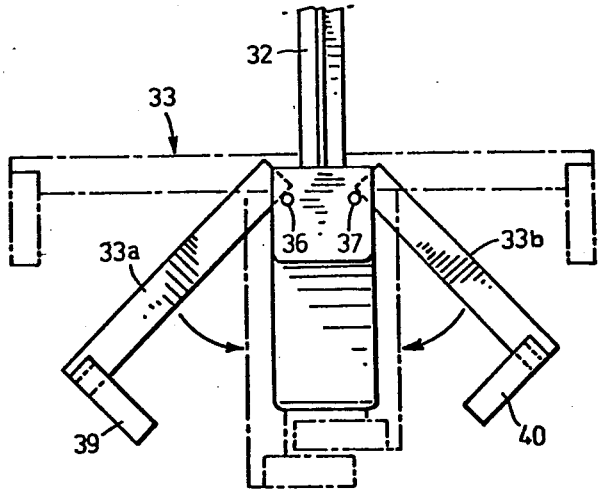
FIG. 4 illustrates a detail of the second device, showing how it is to be collapsed for stowage.
Figure 3:
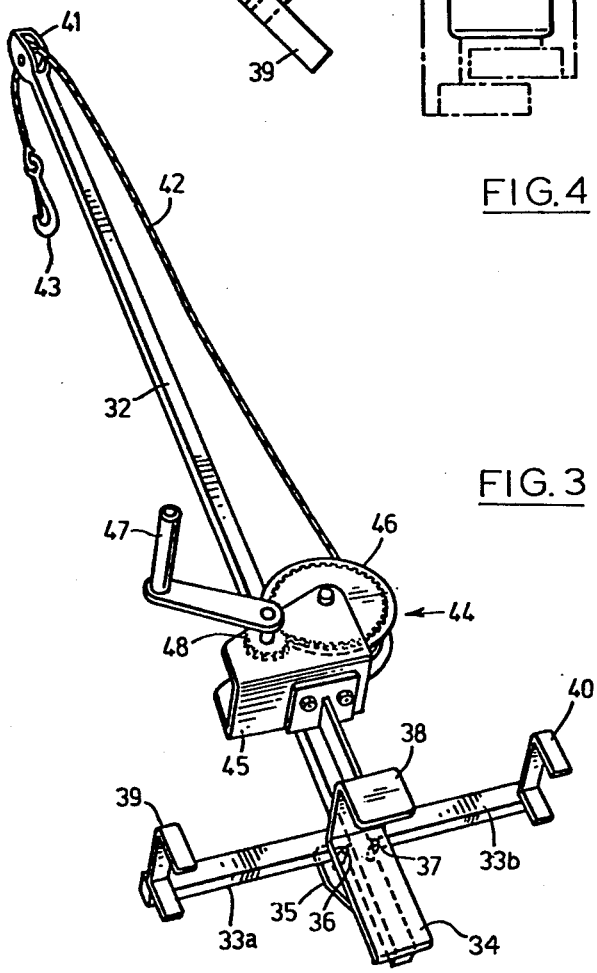
FIG. 3 illustrates a second lifting device according to the invention.

In the modified lifting device shown in FIGS. 3 and 4, the davit comprises a standard 32 having a transverse bar 33 attached thereto adjacent its lower end. The attachment means comprises a pair of rigid mounting plates 34, 35 mounted on the standard, with a pair of pivot pins 36, 37 extending between the plates. The transverse bar 33 comprises a pair of transverse arms 33*a*, 33*b* which are pivotally connected to the mounting plates by the pins 36, 37 so as to be pivotally movable between first and second limit positions. In the first limit position, shown in FIG. 3, the arms 33*a*, 33*b* are aligned for operative engagement with the peripheral flange of the aerial bucket. In the second limit position, shown in phantom in FIG. 4, the arms are folded together in nesting relation so that the lifting device can readily be stowed. The footing of the davit comprises an outward extension 38 of the mounting plate 34, and a pair of angle members 39, 40 rigidly attached to the arms 33*a*, 33*b* and extending outwardly therefrom. Each of these members, which are transversely aligned as shown in FIG. 3 when the device is operative, has a horizontal bearing portion adapted to bear on the upper face of the bucket flange, and a downturned end portion which is adapted to engage the periphery of the flange. The lower end of the standard 32 extends beyond the footing so as to engage the inside of the bucket wall, when in use, and so support the davit in the operative position.

A pulley 41 is fitted to the upper end of the standard 32, this serving as a return pulley for a winch cable 42. A clip 43 or other attachment means is provided at the free end of the cable for attachment to the subject's safety belt or harness in the manner shown in FIG. 1. The winch unit 44 is mounted on a mounting plate 45 carried by the standard 32. This unit is of the type shown in FIG. 1, and comprises a cable drum 46 operated manually by a handle 47 through reduction gearing 48.

The rescue devices described above are robust and simple to use. Being collapsible they can easily be stowed away in a truck when not in use and so are not subject to continual exposure to the elements. Moreover, not being permanently mounted on the boom of the aerial device they do not present an additional load during normal use of the device and do not present an additional encumbrance which would render the aerial device unsuitable for high voltage work.

The rescue devices are most convenient to use in an emergency. The rescue worker simply takes the device out of the truck and opens the footing for engagement with the bucket flange, the device being mounted on the most conveniently accessible side of the bucket. When so mounted, the device is self-supporting in the operative position as shown in FIG. 1. Having attached the clip 25 (or 43) to the subject's safety belt, the rescue worker operates the winch unit so as to lift the subject. When the subject has been raised to a suitable position the davit can then be tilted backwards about its footing, thus serving as a support for the subject who can then easily be lifted from the support.

What we claim is:

1. A portable lifting device designed for the removal of an injured person from a boom supported aerial bucket having a peripheral flange, the device comprising a davit having a footing adjacent one end thereof, the footing being engageable with the bucket flange for supporting the davit in an operative position, a pulley mounted at the other end of the davit, and a winch unit mounted on the davit, the winch unit having a cable extending over the pulley, the cable providing at its free end means for securing engagement with an injured person to be removed from the bucket, wherein the davit comprises a collapsible A-frame with two leg members pivotally connected together at said other end of the davit and a transverse bar pivotally connected to one of the leg members, the other leg member carrying a mounting bracket connected to the free end of the transverse bar, the mounting bracket being slidable along said other leg member between first and second limit positions whereby the leg members can be folded together for stowage of the device.

2. A portable lifting device according to claim 1, wherein said securing means comprises a clip for attachment to a safety belt or harness worn by the person.

3. A portable lifting device according to claim 1, wherein the winch unit comprises a cable drum and a manually operable winding mechanism therefor.

4. A portable lifting device according to claim 1, wherein the footing comprises a pair of flange engaging feet constituted by transversely aligned angle members rigidly attached to the davit, each angle member having a bearing portion adapted to bear on the flange and a downturned end portion engageble with the edge of the flange, the davit having a lower end portion extending beyond the feet so as to bear against the inside of the bucket for supporting the davit in said operative position.

5. A portable lifting device designed for the removal of an injured person from a boom supported aerial bucket having a peripheral flange, the device comprising a davit having a footing adjacent one end thereof, the footing being engageble with the bucket flange for supporting the davit in an operative position, a pulley mounted at the other end of the davit, and a winch unit mounted on the davit, the winch unit having a cable extending over the pulley, the cable providing at its free end means for securing engagement with an injured person to be removed from the bucket, wherein the davit comprises a standard having a transverse bar attached thereto adjacent said one end thereof, the footing comprising at least a pair of feet constituted by transversely aligned angle members rigidly attached to the transverse bar, each angle member having a bearing portion adapted to bear on the bucket flange and a downturned end portion engageable with the edge of the flange, the standard extending beyond the transverse bar at said one end so as to bear against the inside of the bucket for supporting the davit in said operative position, wherein the transverse bar comprises a pair of transverse arms pivotally connected to the standard, the transverse arms being pivotally movable between a first limit position in which they are aligned for operative engagement with the bucket flange and a second limit position at which they are nested together for stowage of the device.

* * * * *

UNITED STATES PATENT AND TRADEMARK OFFICE

CERTIFICATE OF CORRECTION

PATENT NO. : 4468004

DATED : August 28, 1984

INVENTOR(S) : Brian H. Shaver and Patrick J. Palangio

It is certified that error appears in the above-identified patent and that said Letters Patent are hereby corrected as shown below:

The spelling of the first inventor's name is corrected to read -- Brian H. Shaver --

Signed and Sealed this

*Twenty-sixth* Day of *February 1985*

[SEAL]

*Attest:*

DONALD J. QUIGG

*Attesting Officer* *Acting Commissioner of Patents and Trademarks*